United States Patent [19]

Tait

[11] 4,304,167

[45] Dec. 8, 1981

[54] PERFORMER-SUPPORTED KEYBOARD

[76] Inventor: Jocelyn B. Tait, 4 Suffolk St., Nepean, Ontario, Canada, K2G 3P4

[21] Appl. No.: 91,748

[22] Filed: Nov. 6, 1979

[51] Int. Cl.[3] ..... G10C 3/12

[52] U.S. Cl. ..... 84/429; 84/427

[58] Field of Search ..... D17/1–4, D17/9; 84/1.01, 1.17, 177, 327, 376 A, 423 R, 424, 429, 430, DIG. 3, DIG. 17; 224/265

[56] References Cited

U.S. PATENT DOCUMENTS 3,335,629 8/1967 Brodin ..... 84/1.01

4,126,070 11/1978 Hill ..... 84/1.01

*Primary Examiner*—Lawrence R. Franklin

[57] ABSTRACT

A performer-supported keyboard is designed to be worn by a performer or technician, either while standing, or walking, or seated. The keyboard has an arcuate shape, and a rigid support frame, to be supported by one shoulder and the opposite waist of the performer or technician. Second or third keyboards may be associated with the performer-supported keyboard disclosed, and the entire assembly is designed to be readily put on or removed by a performer, and to permit maximum mobility.

13 Claims, 4 Drawing Figures

PERFORMER-SUPPORTED KEYBOARD

Traditional keyboard structures require the player thereof to sit or stand behind or among instruments which are floor supported. While some attempts have been made to provide a portable keyboard, all such prior attempts have involved the use of a neck strap or harness, and keyboards so supported are essentially straight and flat and are relatively uncomfortable for the performer. Such keyboards are relatively difficult to play, and lack in aesthetic appearance, and further, do not provide the keyboardist with any degree of full mobility while performing.

Searches have been conducted in the Canadian and U.S. Patent Offices for the most pertinent prior art. The only patents located as a result of these searches are:

U.S. Pat. No. 3,555,166, Gasser, Jan. 12, 1971, relating to a guitar having auxiliary controls mounted thereon.

U.S. Pat. No. 3,541,912, Radke, Nov. 24, 1970, relating to a keyboard instrument configured as a guitar.

U.S. Pat. No. 2,081, Dwight et al, May 6, 1841, relating to a piano having a slightly curved keyboard.

U.S. Pat. No. 4,126,070, Hill, Nov. 21, 1978 and U.S. Pat. No. 3,335,629, Briodin, Aug. 15, 1967, which both relate to a straight, flat keyboard adapted to be supported by a neck strap.

All of these prior art patents lack the comfort and ease of use provided by the subject structure.

The shaped keyboard which has now been created is designed to be easily supported by a performer, with the weight of the keyboard being distributed comfortably and so as to allow the keyboardist to perform with great freedom, and to walk, dance, or be comfortably seated before a second traditional keyboard, while performing on the performer-supported keyboard hereof.

The keyboard according to this invention has a curved configuration, and provides a support means whereby the weight of the keyboard is comfortably supported by one shoulder and by the waist-hip of the performer on the opposite side from that shoulder.

The invention described herein is directed to a single manual or a multiple manual keyboard, each or all having an arcuate configuration, to facilitate ease of play by a keyboardist.

Communication between the keyboards disclosed herein, and an associated computer or other apparatus is via an insulated umbilical connection, fibre optics, and/or radio transmission.

One object of the invention is to provide a performer-supported keyboard which may also be used to control synthesizers, through routing specified via a computer, and, as desired, to control lighting effects, or other electrical or electronic sound equipment or the like.

A further object of the invention is to provide a keyboard for use in industry where the operation of an intricate and extensive control panel is made much more effective inasmuch as an operator using the portable keyboard disclosed herein is free to move away from a fixed-panel location, as is necessary, for example, to read indicators or the like at a remote location therefrom.

A further object of the invention is to provide a performer-supported keyboard having associated therewith appropriate switches, slide pots, and the like, for control of variations of musical as well as lighting or other desired effects.

A principal object of the invention is to provide a performer-supported keyboard comprising a keyboard which has an arcuate shape defined by the arc of a forearm of a performer as it pivots naturally from one side of the performer then inwardly across his abdomen and upwardly across his chest. A rigid support frame for said keyboard is shown in the attached drawings to be attached thereto near the upper end thereof, said support frame having an upwardly extending portion adapted to curve over a shoulder of the performer to be supported thereby, and a portion curving downwardly across the bottom of the performer's rib cage, on the side opposite said shoulder, and thence curving around the waist and hip of the performer to be further supported thereby. Thus, said keyboard on said support frame may be readily put on or removed by a performer, and permits mobility to said performer while wearing said keyboard.

A further object of the invention is to construct the support frame and the back plate of the keyboard as a single unit, as will be evident to those skilled in the art.

These and other objects of the invention will become apparent with reference to the following description.

DETAILED DESCRIPTION OF PREFERRED EMBODIMENT

Figure 1:
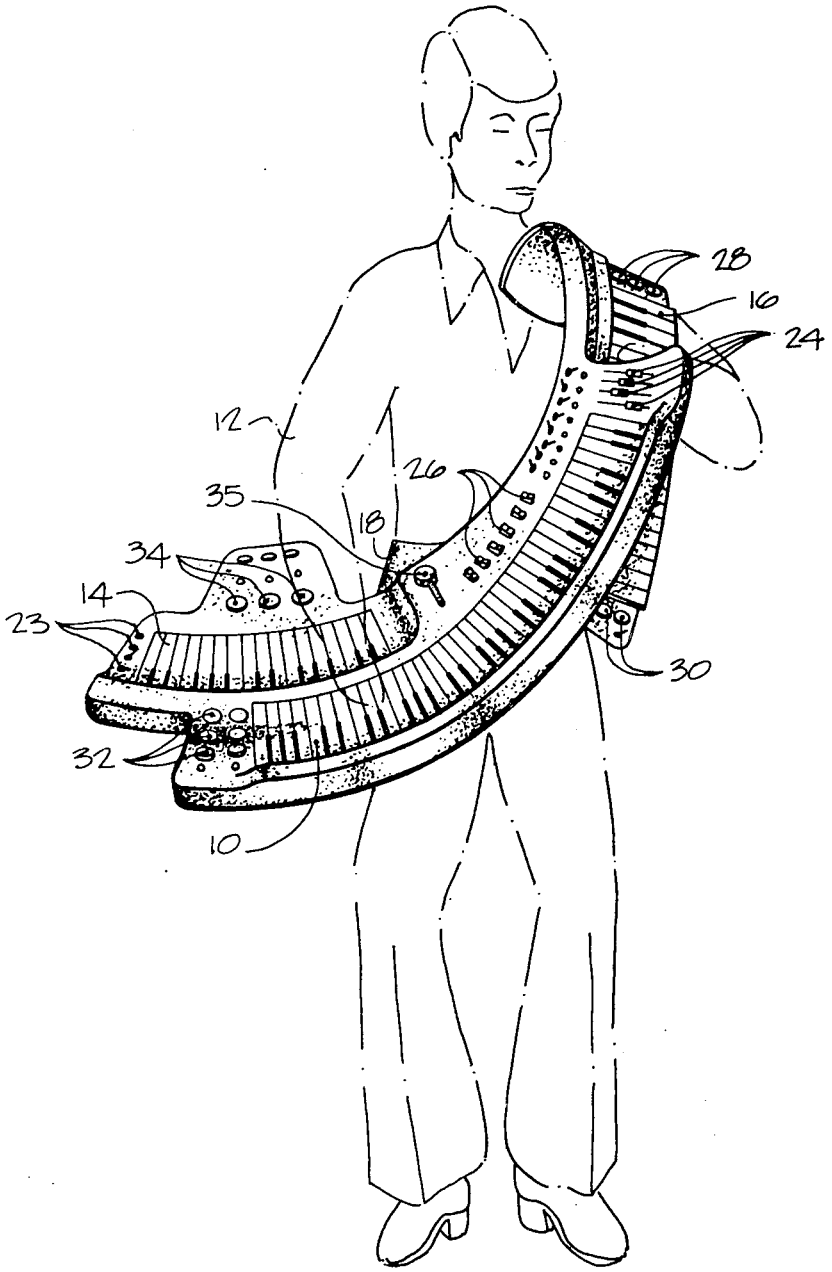
FIG. 1 is a perspective view of one embodiment of a keyboard according to the invention, with a performer shown in broken lines.
Figure 2:
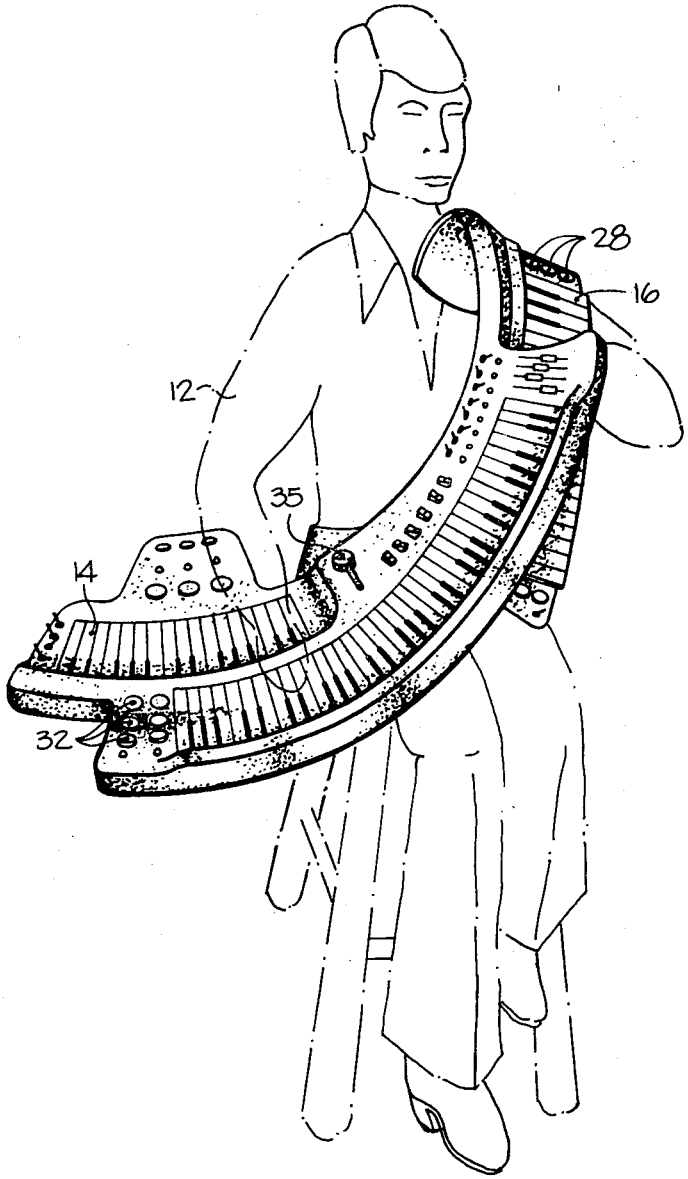
FIG. 2 is a view similar to FIG. 1 with the performer being shown in a seated position.

As seen in FIGS. 1 and 2, a keyboard assembly is being worn by a performer. The keyboard assembly comprises a primary manual 10, having an arcuate configuration, and which follows an arc defined by the forearm 12 of the performer, when it is pivoted naturally from the position shown, thence inwardly across his abdomen and upwardly across his chest, so that the hand of the performer has ready and comfortable access to the keys of manual 10, throughout the length thereof.

It should be understood that while three manuals are illustrated and described herein, the keyboard may comprise, for example, only manual 10.

A secondary manual 14 is illustrated projecting inwardly from the lower portion of primary manual 10 to the right hand side of the performer illustrated, and extending slightly therebeyond. A tertiary or base manual 16 extends downwardly from the shoulder of the performer, to a point near the performer's waist. As is evident from FIGS. 3 and 4, manual 16 is curved to follow the curve defined by the performer's forearm as it is pivoted naturally from above his shoulder to a point slightly below his waist. Again, this arcuate configuration permits ready access to the keys of manual 16, and comfort in playing. Manual 16 is unitary with manual 10. As an alternative it will be evident that manual 16 may be removably engaged with manual 10, as by means of an interlocking slidable joint.

In FIGS. 1 and 2 only a small portion of a support frame 18 is illustrated, near the waist and hip of the performer, adjacent keyboard 14.

Figure 3:
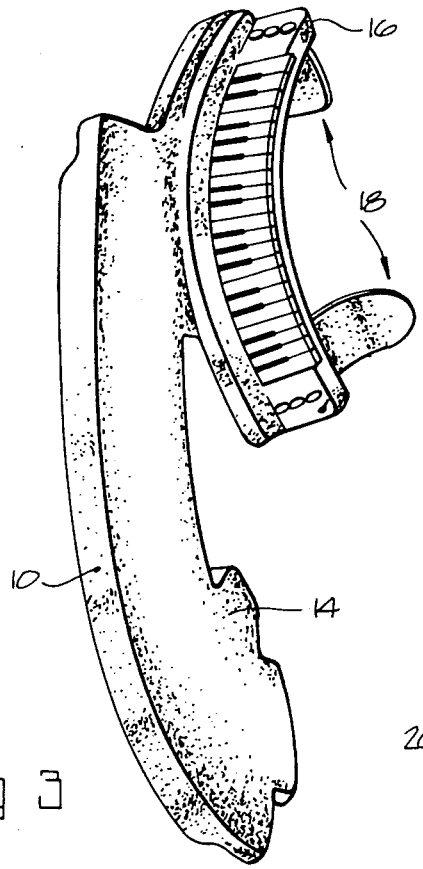
FIG. 3 is a rear perspective of the keyboard of FIG. 1.
Figure 4:
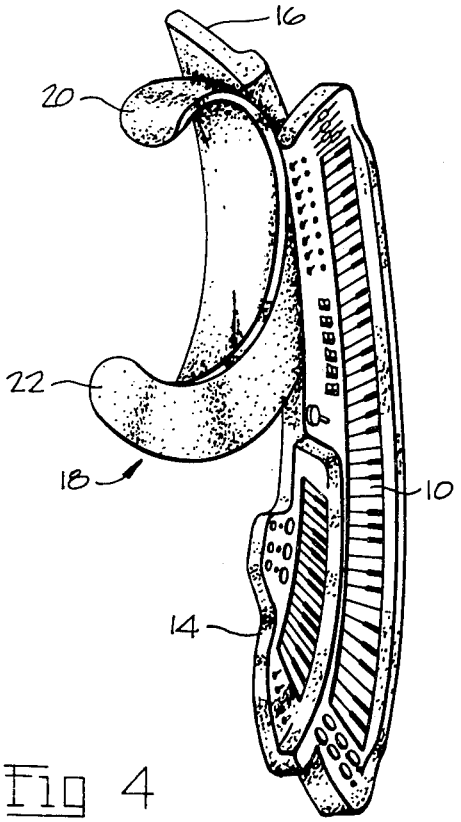
FIG. 4 is a front isometric.

As is more evident in FIGS. 3 and 4, the support frame, indicated generally at 18, comprises a curved portion 20 adapted to be supported by one shoulder of the performer, and a second curved portion 22 adapted to be received around a waist and hip of the performer, to provide further support therefor.

Referring to FIGS. 1 and 4, it will be seen that secondary manual 14 follows the arc defined by primary manual 10, but is on a slightly lower plane than manual 10, to further facilitate playing thereof, as the performer's arm is moved rearwardly from manual 10 to manual 14. It will also be evident that, as desired, manual 10 and manual 14 may be on the same plane.

Moreover, manual 10 is preferably provided with an upwardly and outwardly extending curve away from manual 14. In other words, while the keys of manual 14 may be at or near the horizontal when in use, the keys of manual 10 will preferably extend outwardly and upwardly to an angle somewhat above the horizontal so as to further facilitate and make more comfortable the playing thereof.

A plurality of controls is illustrated in the drawings, including toggle switches 23, slide pots 24, rocket switches 26, and rotary switches 28, 30, 32 and 34, and paddle 35 to provide easy control of musical, lighting, or other desired effects.

The support frame 18 illustrated herein is shown as being unitary, and being configured to conform with a performer's stature on a custom-fit basis. It will be appreciated, however, that support frame 18 may be adjustable, through telescopic connection means or slidable interlocking connection means, or the like, whereby the frame may be extended or reduced, between shoulder support portion 20 and hip support portion 22, so as to accommodate players of varying stature.

It will also be appreciated that a mirror image of the keyboard instrument disclosed herein may be provided for a left-handed musician.

The foregoing is by way of example only and the invention should be limited only by the scope of the appended claims.

I claim:

1. A performer-supported keyboard comprising:

a keyboard which has an arcuate shape defined by the arc of a forearm of a performer as it pivots naturally from one side of the performer then inwardly across his abdomen and upwardly across his chest;

a rigid support frame for said keyboard being attached to said keyboard near the upper end thereof, said support frame having an upwardly extending portion adapted to curve over a shoulder of the performer to be supported thereby, and a portion curving downwardly across the bottom of the performer's rib cage, on the side opposite said shoulder, and thence curving around the waist and hips of the performer to be supported thereby;

whereby said keyboard on said support frame may be readily put on or removed by a performer, and permit mobility to said performer while wearing such keyboard.

2. A performer-supported keyboard according to claim 1, and including a secondary manual projecting inwardly from the lower portion of the keyboard and extending slightly outwardly therefrom.

3. A performer-supported keyboard according to claim 1 or 2, and including a tertiary manual affixed to said support frame near the upper end thereof rearwardly of said first-named keyboard, and being curved to follow the curve defined by the performer's associated forearm as it pivots at the elbow from a point above his shoulder to a point slightly below his waist.

4. A musical instrument adapted to be supported by a performer comprising a panel member having a curved, three-dimensional, elongated surface, a key board comprising finger operated elements arranged one after another in a series along at least a substantial portion of the length of said surface, said surface being curved to form an arc corresponding generally to an arc traced by an operating hand of said performer as the arm is pivoted during the playing of the instrument and being also curved to permit the fingers of said hand to readily operate any of said elements, and a supporting apparatus connected to said panel member to support said panel member in an operating position on said performer.

5. A performing instrument according to claim 4 including, a third curved surface located at the end of said first mentioned surface opposite said one end, a third set of finger operated elements arranged in a series along at least a substantial portion of the length of said third surface.

6. A performing instrument according to claim 5 wherein said third curved surface extends in a generally downwards direction from a shoulder of said performer when said panel member is in said operating position.

7. A performing instrument according to claim 6 wherein said third surface forms an arc corresponding generally to an arc traced by the hand operating said third set of elements as the associated arm is pivoted during the playing of the instrument.

8. A performing instrument according to claim 4 wherein said panel member has an arcuate shape arranged to extend partially around the front of a person's body.

9. A performing instrument according to claim 4 wherein there is a second surface adjacent one end of said first mentioned surface with a second set of finger operated elements arranged in a series along at least a substantial portion of the length of said second surface.

10. A performing instrument according to claim 1 wherein said supporting apparatus comprises a support frame connected to said panel member, said frame having an upper portion adapted to extend over a shoulder of said performer and a lower portion adapted to fit about at least part of the waist region of the performer.

11. A performing instrument according to claim 4 wherein said supporting apparatus is a rigid support frame having an upwardly extending rigid portion adapted to curve over a person's shoulder and a lower rigid portion curving below the rib cage of said person on the side opposite said shoulder.

12. A performing instrument according to claim 11 wherein said rigid support frame is custom-fitted for a specific person.

13. A performing instrument according to claim 4 wherein said second surface is located adjacent the lower end of said first mentioned surface when said panel member is in said operating position, said second surface when said instrument is in use being disposed upwardly and inwardly of the first surface in a direction closer to the performer's elbow.

* * * * *